US008392016B2

(12) United States Patent
Samarov et al.

(10) Patent No.: US 8,392,016 B2
(45) Date of Patent: Mar. 5, 2013

(54) ADAPTIVE METHOD FOR MANUFACTURING OF COMPLICATED SHAPE PARTS BY HOT ISOSTATIC PRESSING OF POWDER MATERIALS WITH USING IRREVERSIBLY DEFORMABLE CAPSULES AND INSERTS

(75) Inventors: Viktor Samarov, Buena Park, CA (US); Dmitry Seliverstov, Anaheim, CA (US); Evgeny Khomyakov, Buena Park, CA (US); Igor Troitski, Henderson, NV (US); Roman Haykin, Lords Valley, PA (US)

(73) Assignee: LNT PM Inc., Las Vegas, NV (US)

( * ) Notice: Subject to any disclaimer, the term of this patent is extended or adjusted under 35 U.S.C. 154(b) by 267 days.

(21) Appl. No.: 12/803,358

(22) Filed: Jun. 25, 2010

(65) Prior Publication Data

US 2011/0320032 A1 Dec. 29, 2011

(51) Int. Cl.
*G06F 19/00* (2011.01)
*B22F 7/00* (2006.01)

(52) U.S. Cl. ..... 700/207; 419/5

(58) Field of Classification Search ..... 700/132, 700/206, 269; 419/5, 8, 49
See application file for complete search history.

(56) References Cited

U.S. PATENT DOCUMENTS

| | | | | |
|---|---|---|---|---|
| 3,844,778 | A | 10/1974 | Malone | 419/5 |
| 3,992,202 | A | 11/1976 | Dulis et al. | 419/5 |
| 3,996,048 | A | 12/1976 | Fiedler | 419/5 |
| 4,401,723 | A | 8/1983 | Aslund et al. | 428/554 |
| 4,634,572 | A | 1/1987 | Lichti | 376/416 |
| 4,657,822 | A | 4/1987 | Goldstein | 428/552 |
| 4,726,927 | A | 2/1988 | Morgan et al. | 419/9 |
| 4,820,484 | A | 4/1989 | Ekbom | 419/49 |
| 4,904,538 | A | 2/1990 | Juhas | 428/552 |
| 5,540,882 | A | 7/1996 | Billgren | 419/8 |
| 5,623,727 | A | 4/1997 | Vawter | 419/51 |
| 5,640,667 | A | 6/1997 | Freitag et al. | 419/31 |
| 5,939,011 | A | 8/1999 | White et al. | 264/401 |
| 5,960,249 | A | 9/1999 | Ritter et al. | 419/6 |
| 5,997,273 | A | 12/1999 | Laquer | 425/394 |
| 6,042,780 | A | 3/2000 | Huang | 419/36 |
| 6,048,432 | A | 4/2000 | Ecer | 156/263 |
| 6,103,187 | A | 8/2000 | Kim et al. | 419/23 |
| 6,120,570 | A | 9/2000 | Packer et al. | 51/309 |
| 6,168,871 | B1 | 1/2001 | Ritter et al. | 428/548 |
| 6,210,633 | B1 | 4/2001 | Kratt et al. | 419/49 |
| 6,355,211 | B1 | 3/2002 | Hung | 419/49 |
| 6,482,533 | B2 | 11/2002 | Van Daam et al. | 428/553 |

(Continued)

OTHER PUBLICATIONS

W.X. Yuan, J. Mei, V. Samarov, D. Seliverstov, X. Wu, Computer modelling and tooling design for near net shaped components using hot isostatic pressing, Journal of Materials Processing Technology, vol. 182, Issues 1-3, Feb. 2, 2007, pp. 39-49.*

(Continued)

*Primary Examiner* — Dave Robertson

(57) ABSTRACT

The invention discloses adaptive method for manufacturing of parts of the similar complex shape by using hot isostatic pressing of powder materials and irreversibly deformable capsules and inserts utilized as adaptation tools. The method is based on creation of a virtual part by mathematical computer modeling of densification and shrinkage; manufacturing of a test part; determination of discrepancies between manufactured test part and virtual test part; adaptation of mathematical model by virtual iterations so that discrepancies between manufactured and virtual and parts are minimized; manufacturing of every complex shape part of the given group by using adoptive method skipping the step of manufacturing a test part.

6 Claims, 1 Drawing Sheet

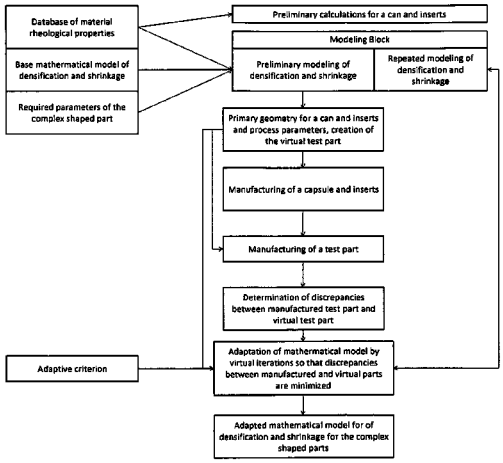

U.S. PATENT DOCUMENTS

| | | | | |
|---|---|---|---|---|
| 6,630,162 | B1 | 10/2003 | Nilvebrant et al. | 419/28 |
| 6,691,397 | B2 | 2/2004 | Chakravarti | 29/527.1 |
| 7,112,301 | B2 | 9/2006 | Thorne et al. | 419/5 |
| 7,234,920 | B2 | 6/2007 | Imbourg et al. | 415/213.1 |
| 7,261,855 | B2 | 8/2007 | Troitski et al. | 419/5 |
| 7,407,622 | B2 | 8/2008 | Voice et al. | 419/5 |

OTHER PUBLICATIONS

Trinh, T.-K.L.; Meyer, D.G.; , "Learning HIP dynamics with neural networks," Neural Networks. 1991 IEEE International Joint Conference on , vol., No., pp. 1500-1505 vo1.2, Nov. 18-21, 1991.*

* cited by examiner

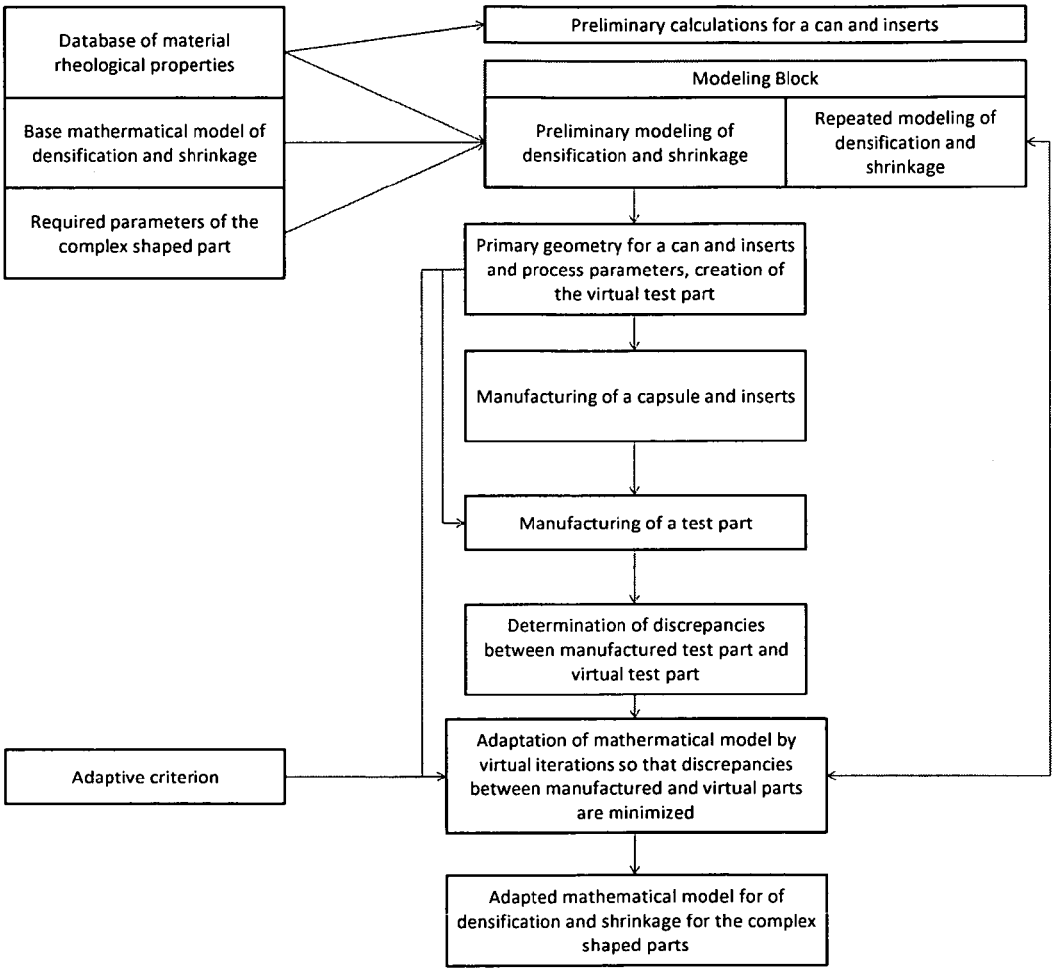
Database of material rheological properties
Base mathermatical model of densification and shrinkage
Required parameters of the complex shaped part
Preliminary calculations for a can and inserts
Modeling Block
Preliminary modeling of densification and shrinkage
Repeated modeling of densification and shrinkage
Primary geometry for a can and inserts and process parameters, creation of the virtual test part
Manufacturing of a capsule and inserts
Manufacturing of a test part
Determination of discrepancies between manufactured test part and virtual test part
Adaptive criterion
Adaptation of mathermatical model by virtual iterations so that discrepancies between manufactured and virtual parts are minimized
Adapted mathematical model for of densification and shrinkage for the complex shaped parts

ADAPTIVE METHOD FOR MANUFACTURING OF COMPLICATED SHAPE PARTS BY HOT ISOSTATIC PRESSING OF POWDER MATERIALS WITH USING IRREVERSIBLY DEFORMABLE CAPSULES AND INSERTS

FIELD OF THE INVENTION

The present invention relates to manufacturing of complex shape parts by using hot isostatic pressing of powder materials.

BACKGROUND OF THE INVENTION

A number of techniques and systems are well known that use powder materials and hot isostatic pressing for production of complex shape parts.

U.S. Pat. No. 3,844,778 to Malone, et al. discloses a method for producing an alloy structure having deep surface grooves therein by bonding of alloy powder to a fully dense member, such as a plate having on surfaces thereof nondeformable ceramic mandrels defining the grooves desired. After compacting to fully densify the alloy powder and bond it to the fully dense alloy plate member the ceramic mandrels are removed to expose the grooves. An air-tight, evacuated assembly constituting the powder, plate and nondeformable ceramic mandrels is provided for unitary hot isostatic compacting.

U.S. Pat. No. 3,992,202 to Dulis, et al. discloses a method for producing a powder-metallurgy article having at least one aperture therein; the article is produced by providing a dense, nondeformable core having a configuration corresponding to the desired configuration of the aperture in said article; the core is placed in a particle charge having a composition corresponding to that desired in the article; the position of the core within the particle charge corresponds to the desired position of the aperture within the final compacted product. The core has a coefficient of thermal expansion greater than that of said article, whereby after compacting removal of the core from the article to create the aperture is facilitated. A separating medium may be used between the core and the powder. The assembly constituting the container, core and powder is hot isostatically compacted, and upon cooling the container and core are removed from the densified article.

U.S. Pat. No. 3,996,048 discloses a method for producing holes in powder metallurgy parts. A procedure for providing bores or other internal passages in hot isostatically pressed powder metal articles, especially those formed of nickel- or cobalt-base superalloys in which the passage is defined by a thin walled metal tube filled with refractory oxide (MgO or SiO.sub.2), which is embedded in the metal powder. After hot isostatic pressing the refractory oxide core is removed by leaching, leaving a smooth bore in the finished article.

U.S. Pat. No. 4,401,723 to Aslund, et al. discloses a method for production of a capsule for pressings pressed by isostatic pressure and to these pressings used for extruding metallic objects, particularly tubes, of stainless steel, the outer and inner wall of the capsule consisting of thin-walled sheet metal, and at least the outer wall having substantially the same strength properties in the axial direction over its circumference and particularly consisting of a spiral-welded tube and being preferrably provided with a bulge which is directed outwardly against the shrinkage occurring during isostatic pressing, and at least on the front end of the capsule an insert being provided, which consists of one or more pieces of a ductile solid material or a ductile material pressed from powder.

U.S. Pat. No. 4,634,572 discloses a system for automatically consolidating a plurality of metallic or ceramic (or mixtures thereof) powder performs. The system comprises an assembly container wherein a consolidation container is filled with hot consolidation particles for facilitating the consolidation, and a hot preform to be consolidated thereby. The atmosphere of the assembly container is maintained hot and inert or reducing during assembly of the consolidation charge. Further disclosed are means for automatically delivering the consolidation containers, consolidation particles and preforms to the assembly container. The system includes means for conveying the consolidation containers to a press for consolidation, for separating the containers from the consolidation particles and consolidated preform after pressing, and for recycling the consolidation particles and consolidation containers. The system can be run by suitable logic control on a continuous basis allowing for the automatic consolidation of a plurality of preforms to thereby produce a plurality of consolidated articles of manufacture.

U.S. Pat. No. 4,657,822 discloses fabrication of hollow, cored and composite shaped parts from selected alloy powders. Alloy powder is packed into a mold which comprises a complex-shaped solid aphite inner core and a similarly complex-shaped thin glass outer wall. The mold is evacuated, sealed, and then heated to the alloy sintering temperature, the glass softens and applies an isostatic pressure on the alloy as the alloy particles consolidate. After the consolidation step, the mold and its contents are cooled and the glass and graphite materials are removed from the alloy object. This method is particularly useful for preparing complex fittings of Nitinol shape memory alloys.

U.S. Pat. No. 4,726,927 discloses a method and apparatus for producing a powder metal part having a plurality of cavities. The method involves introducing a metal powder and an apparatus into a mold, the apparatus being made of a plurality of solid pieces which are in the shape of the cavities to be formed. The pieces are joined together by joining means and are positioned relative to each other by adjusting means so that the cavities formed there from are equally spaced about the center of the part. The apparatus is then removed from the mold, and the powder is then isostatically pressed in the mold to produce a green part which is then sintered to form the final part having the cavities.

U.S. Pat. No. 4,820,484 to Ekbom discloses a method in producing a molding of an iron alloy, wherein the molding is produced by hot isostatic pressing of a prealloyed powder, performed at a pressure ranging between 100 and 150 Mpa, and at a temperature ranging between 1230 degree and the 1270 degree C.

U.S. Pat. No. 4,904,538 to Juhas et al. discloses a method for one step HIP canning of powder metallurgy composites. The objects of the inventions are achieved by a single step hot isostatic pressing (HIP) canning of powder metallurgy composite specimens wherein each specimen is placed inside of a refractory metal ring and sandwiched between two refractory metal sheets. The resultant assembly is placed in a die which is loaded in a hot vacuum press. The specimen is heated in the vacuum to a temperature sufficient to burn off binders. This temperature is then raised when all the binder is burned off, and a pressing load is applied to produce deformation of the refractory metal ring and a solid state diffusion weld between the ring and the face sheets. The deformation continues until the composite specimen partially densifies, thereby locking the specimen geometry in place. The resultant can is then used in a further HIP operation to complete densification of the specimen.

U.S. Pat. No. 5,540,882 discloses a method for powder metallurgical manufacturing of a body which has a through hole, for example a hollowed tool blank or thick-walled tube. The characteristic feature of the method is that in an outer capsule there is provided a tube (6) having substantially the same length as the capsule, so that the tube extends substantially through the entire length of the capsule, that in the tube there is provided a core (5) which also extends through the capsule and the entire length of the tube, that the space between the tube (6) and the inner side of the capsule (1) is filled with a metal powder (9) which shall form the desired body, that the space (10) in the tube (6) between the core (5) and the inner side of the tube is filled with a non-metallic powder (11), that the capsule is closed hermetically, and that the closed capsule and its content is subjected to hot isostatic compaction at a temperature exceeding 1000 C., so that the metal powder is compacted to complete density.

U.S. Pat. No. 5,623,727 to Vawter discloses a method for manufacturing powder metallurgical tooling which utilizes a refractory die in which surfaces of the refractory die define the pattern of the article to be fabricated. The refractory die is positioned in a forging die of a furnace where it is supported on a lower ram. The forging die is filled with fine particulate materials, which cover the refractory die. The forging die with its contents of the refractory die and particulate materials is heated in an inert or reducing atmosphere at a threshold temperature. High pressure is subjected to the forging die with its contents of the refractory die and particulate materials under the influence of at least one pressure means, a movable upper ram. The movable upper ram is pressed in an axial downward direction, wherein the pressure is transferred to the particulate materials. As a result, the fine particulate material is consolidated to a dense body with surfaces which have been shaped by the refractory die. The temperature is lowered in the forging die so as to remove the consolidated article and refractory die. The refractory die is removed by mechanical thermal shock or chemical leaching from the consolidated article.

U.S. Pat. No. 5,640,667 to Freitag, et al. discloses a method for laser-direct fabrication of full-density metal articles using hot isostatic processing. According to a first embodiment of the invention, the interior portion of the article is formed by way of the component. In one embodiment, an airfoil is configured to have double walls through which cooling air flows.

U.S. Pat. No. 5,997,273 to Laquer discloses differential pressure HIP forging in a controlled gaseous environment. Apparatus and procedures are presented for forging, or hot working bulk ceramics, including high temperature superconductors and other sensitive materials, under precisely controlled conditions of pressure, temperature, atmospheric composition, and strain rate. A capsule with massive end plates and an independent gas supply is located in a modified hot isostatic press (HIP). Essentially uniaxial deformation of a pre-compacted disc with forces of up to 500,000 Newtons (50 tons) and at temperatures of up to 1000 C. can be achieved. The separate gas supply to the capsule can maintain a specified gaseous atmosphere around the disc, up to the operating pressure of the HIP. The apparatus is designed to tolerate partial oxygen pressures of up to 20%.

U.S. Pat. No. 6,042,780 to Huang discloses a method for producing high performance components by the consolidation of powdered materials under conditions of hot isostatic pressure. The method uses the inclusion of reactive materials mixed into pressure-transmitting mold materials and into the powder to be consolidated to contribute to in-situ materials modification including purification, chemical transformation, and reinforcement. The method also uses encapsulation of the mold in a sealed container to retain the mold material in position, and to exclude air and contaminants.

U.S. Pat. No. 6,048,432 to Ecer discloses the process of forming a part from laminae of powders of materials such as metals, ceramics, intermetallics and composites of such materials, that include forming laminae; forming a stack of the laminae characterized as having a configuration from which a part is to be formed; heating the stack to consolidation temperature, and applying pressure to the heated stack to consolidate the laminae in the stack.

U.S. Pat. No. 6,103,187 to Kim, et al. discloses a process of the production of multilayered bulk materials. A plurality of constituting powders of a desired multilayered material are mixed at a predetermined ratio, particle of the powders being smaller than 100 .mu.m in size. The powder mixture is mechanically alloyed for a predetermined period of time by using a high-energy ball mill in an argon-filled glove box. The mechanically alloyed powder is loaded in a mold and is then hot-pressed under a uniaxial compressive pressure at a predetermined temperature, resulting in a composition having multilayered structure. The process according to the present invention provides an effective way of overcoming thickness limitations of conventional multilayered materials and enabling low-cost mass production of multilayered materials.

U.S. Pat. No. 6,120,570 to Packer, et al. describes process for manufacturing inserts with holes for clamping. According to the present invention there is provided a method of making a cutting insert with a hole for clamping to a tool holder wherein a super-hard abrasive material is sintered and simultaneously bonded to a sintered cemented carbide body with a hole inside a container under elevated pressure and temperature conditions. During sintering the hole is filled with a plug which after sintering is removed.

U.S. Pat. No. 6,168,871 to Ritter, et al. discloses a method for forming high-temperature components and components formed thereby. The method entails forming a shell by a powder metallurgy technique that yields an airfoil whose composition can be readily tailored for the particular service conditions of the component. The method generally entails providing a pair of inner and outer mold members that form a cavity therebetween. One or more powders and any desired reinforcement material are then placed in the cavity and then consolidated at an elevated temperature and pressure in a non-oxidizing atmosphere. Thereafter, at least the outer mold member is removed to expose the consolidated powder structure. By appropriately shaping the mold members to tailor the shape of the cavity, the consolidated powder structure has the desired shape for the exterior shell of a component, such that subsequent processing of the component does not require substantially altering the configuration of the exterior shell. The airfoil can be produced as a free-standing article or produced directly on a mandrel that subsequently forms the interior structure of the component. In one embodiment, an airfoil is configured to have double walls through which cooling air flows.

U.S. Pat. No. 6,210,633 to Kratt, et al. discloses a novel method of manufacturing articles of a complex shape by subjecting powder material to Hot Isostatic Pressing (HIP). The method involves manufacturing a capsule with at least one insert. The capsule is filled with outgassed powder. Thereafter, the powder in the capsule is subjected to hot isostatic pressing. The capsule is removed to produce a finished article, such as a bladed disk. The thickness of capsule walls is made variable so as to provide substantially unidirectional axial deformation of the powder during the Hot Isostatic Pressing.

U.S. Pat. No. 6,355,211 to Hung discloses a method for producing high performance components by the consolidation of powdered materials under conditions of hot isostatic pressure. The method uses the inclusion of reactive materials mixed into pressure-transmitting mold materials and into the powder to be consolidated to contribute to in-situ materials modification including purification, chemical transformation, and reinforcement. The method also uses encapsulation of the mold in a sealed container to retain the mold material in position, and to exclude air and contaminants.

U.S. Pat. No. 6,482,533 to Van Dawn, et al. discloses an article having a hollow cavity formed therein and a method for forming the same. The article includes a hollow structure having an open end and a body portion that is surrounded by a powdered material. The article is processed in, for example, a hot isostatic pressing operation, to permit a pressurized fluid to consolidate the powdered material. The pressurized fluid is permitted to pass through the open end of the hollow structure and into the body portion to thereby prevent the body portion from collapsing while the powdered material is being consolidated.

U.S. Pat. No. 6,630,102 to Wilmes discloses a process of making a powder metal material comprising: placing a powder of an alloy into a capsule; compressing the capsule; forming a slug from the capsule; subjecting the slug to one of forming by forging and rolling; and shaping the slug to form a cross section shape having a width and a depth, wherein during the shaping, a difference between a deformation in a direction of the width and a deformation in a direction of the depth is a maximum of 2 times a lower value of the deformation in the width direction and of the deformation in the depth direction. Further, this invention is directed to a material produced using powder metallurgy with a rectangular or flat elliptical cross section and includes a slug with such a rectangular or flat elliptical cross sectional shape is prepared and subjected to a shaping in such a way that the difference between the forming in the direction of the width and the forming in the direction of the depth of the cross section of the broad-flat material is at most two times. Moreover, when the hot isostatically pressed slug is subjected to a compressive shaping with a degree of compression of at least twofold, where after a stretch shaping of the compressed slug occurs while forming the broad-flat material. Another aspect of the invention is for the hot isostatically pressed slug to be subjected to a diffusion annealing treatment with a maximum temperature of about 20.degree below the solidus temperature of the alloy and a minimum annealing duration of about 4 hours, whereafter it is forged and/or rolled into a broad-flat material by a stretch forming.

U.S. Pat. No. 6,691,397 to Chakravarti discloses a method for production of clad piping and tubing which includes the steps of providing a support billet, finished to a desired, predetermined dimension, having a cladding surface, and providing a CRA cladding material billet, similarly finished to a desired, predetermined dimension. The dimension of the CRA cladding material billet is predetermined such that the CRA cladding material fits onto a cladding surface of the support billet establishing an interface gap. Sealing the interface gap, evacuating the interface gap to form an assembly and Hot Iso-statically Pressing the assembly to metallurgically bond the CRA cladding material billet to the support billet to form a composite billet. The composite billet is extruded at high temperature to form the clad piping or tubing. The clad piping or tubing formed in also disclosed.

U.S. Pat. No. 7,112,301 to Thorne, et al. discloses method for HIP manufacture of a hollow component. Forming a hollow structure having an internal coating includes the steps of placing a core shaped to form the internal surface of the structure in a mould, filling the mould with a material powder, hot isostatically pressing the powder about the mould to consolidate the powder, and removing the core from the hollow structure formed, wherein a coating is applied to the core prior to placement in the mould, which coating bonds to the hollow structure formed, during the hot isostatic pressing, to form the internal coating.

U.S. Pat. No. 7,234,920 to Imbourg et al. discloses production of turbine casing having refractory hooks by a powder metallurgy method. A turbine stator casing comprising a jacket and fastener hooks for fastening a turbine distributor nozzle, the hooks projecting from the inside face of the jacket, said jacket being made of a first alloy by hot isostatic compression using metal powder, said fastener hooks being made out of a second alloy that is more refractory than the first, and being secured to said jacket by diffusion welding during the hot isostatic compression. The casing also comprises inserts passing through the fastener hooks and through said jacket. These inserts, which are likewise secured to the jacket by diffusion welding, serve during manufacture of the casing to fasten the hooks to a mold portion inside which the jacket is formed.

U.S. Pat. No. 7,261,855 to Troitski et al. discloses method for manufacturing complex shape parts including parts with cavities from powder materials by hot isostatic pressing with controlled pressure inside the HIP tooling and multi-layer inserts including hollow inserts. Controlled pressure inside the HIP tooling is provided by injecting the HIP gas media into the cavities of the hollow inserts.

U.S. Pat. No. 7,407,622 to Voice et al. discloses a method of manufacturing a hollow article by powder metallurgy comprising: the steps of (a) forming a container, (b) placing at least one metal insert at a predetermined position within the container and filling the container with metal powder, the at least one metal insert having a predetermined pattern of stop off material on at least one surface of the metal insert, (c) evacuating the container, (d) sealing the container, (e) hot pressing the container to consolidate the metal powder into a consolidated metal powder preform, (f) removing the container from the consolidated metal powder preform, (g) heating the consolidated metal powder preform and supplying a fluid to the predetermined pattern of stop off material to hot form at least a portion of the consolidated metal powder preform to form a hollow metal article.

Patents and publications know to the authors of the present invention, including those mentioned above, describe different ways of making complex shape parts by hot isostatic pressing of powders in capsules. However, all known methods are based on the a-priori data of the HIP process parameters, which are not able to describe the process precisely. Therefore, the manufacturing process synthesized by using standard mathematical model based on a-priori data leads to numerous expensive experimental iterations in getting a part of required quality.

The present invention differs from the existing methods by using manufacturing process which is synthesized by adaptive correction of the standard mathematical model and parameters of the technological process that enables to substantially reduce the development expenses and increases the quality of the manufactured parts.

SUMMARY OF THE INVENTION

The invention comprises an adaptive method for manufacturing of parts of the similar complex shape by using hot isostatic pressing of powder materials and irreversibly deformable capsules and inserts utilized as adaptation tools. The method comprises: selection of a part of the most complicated geometry among the similar complex shape parts to be made from a given powder material by hot isostatic pressing; specification of the initial geometry of the capsule, inserts, and HIP process parameters by using mathematical modeling basing on the initial database of material properties of the powder, capsules, inserts and the geometry of a selected complex shape part; creation of a virtual part; manufacturing of a test complex shape part; analysis of the discrepancies between the manufactured test part and the said virtual test part and adaptation of the base computer model so that the discrepancies between the manufactured test part and the said virtual test part are minimized; application of the adapted mathematical model of densification and shrinkage of irreversibly deformed capsules, inserts and powder during hot isostatic pressing to the calculation of the geometrical parameters of the capsule and inserts for the given complex shape part and the other parts of the similar complex shape made from a given powder material; manufacturing of every part of the given group of the similar complex shape parts is made by using hot isostatic pressing of the powder material with geometry of the irreversibly deformed cans, inserts and parameters of the HIP process specified by using the created adapted computer model.

DESCRIPTION OF THE DRAWING

FIG. 1 shows a block diagram of creation of adapted mathematical model for of densification and shrinkage for the complex shape parts: the block "Parts of the similar complex shape" includes information about a group of parts which is transferred to blocks "Preliminary calculations for the can and inserts" and "Modeling block"; block "Base mathematical model of densification and shrinkage" comprises standard mathematical model which is transferred into "Modeling block"; the block "Database of material rheological properties" includes formed database which is transferred to "Modeling block"; the block "Required parameters of the complex shape part" comprises information about all necessary parameters, which is transferred to "Modeling block"; "Modeling block" comprises computer software producing preliminary modeling and transfers the produced information to the block "Primary geometry for can and inserts and process parameters, creation of the virtual test part"; block "Primary geometry for can and inserts and process parameters, creation of the virtual test part" specifies primary geometry for can and inserts and process parameters, creates the virtual test part and transfers this information to blocks "Manufacturing of a capsule and inserts" and "Manufacturing of a test part"; the block "Manufacturing of a capsule and inserts" manufactures capsule and inserts that is necessary for work of "Manufacturing of a test part"; block "Manufacturing of a test part" creates manufactured test part; the block "Determination of discrepancies between manufactured test part and virtual test part" determines the discrepancies between manufactured test part and virtual test part and transfers this information to the block "Adaptation of mathematical model by virtual iterations so that discrepancies between manufactured and virtual and parts are minimized"; block "Adaptive criterion" forms adaptive test and transfers this test to the block "Adaptation of mathematical model by virtual iterations so that discrepancies between manufactured and virtual and parts are minimized", which creates information necessary for creation of adaptive mathematical computer model, which is transferred to the block "Adapted mathematical model for of densification and shrinkage for the complex shape parts".

DETAILED DESCRIPTION OF THE INVENTION

The purpose of the present invention is to disclose an adaptive method for manufacturing a group of similar complex shape parts by using powder materials and hot isostatic pressing, for example, impellers of gas compressors and rocket engines, housings and casings of turbo-machinery. Each part of such a group has similar external and internal geometry, including cavities, but differs in sizes and shape details.

The principal concepts of the invention use the following definitions:

Parts of the similar complex shape—a group of parts which should be manufactured from the same powder material using HIP and have similar complex shape including internal structure, but may have different sizes.

Base mathematical model of densification and shrinkage—standard mathematical model based on the equations for the irreversible compressible porous media, describing densification of powder material in irreversibly deformed capsules, containing inserts that form the internal structure during hot isostatic pressing, i.e. under the influence of uniform pressure, temperature and time, accounting for the rheological properties of powder material as well as the material of capsules and inserts as a function of temperature, pressure and time.

Database of material rheological properties—this data base is built by the special experiments including densification of powder material in the interrupted HIP cycles and obtaining porous samples and then testing these samples on hot upsetting at the temperature of the interruption of the HIP cycles with further interpolation of the values of the yield strength of powder material as a function of temperature.

Required parameters of the complex shape part—parameters, which include final density achieved as a result of HIP, geometrical parameters of external and internal surfaces, tolerances.

Modeling block—a block comprising computer software producing preliminary and iterative repeated modeling of densification and shrinkage of a can of a given geometry containing a given powder and inserts under hot isostatic pressing Virtual test part—a virtual object, that is created in the said modeling block as a result of preliminary modeling of densification and shrinkage of an irreversibly deformed capsule with powder and inserts during hot isostatic pressing and presents a computer model of the given complex shape part obtained after the said modeling.

Manufactured test part—a part, that is manufactured from powder material by using the geometry of the irreversibly deformed can and inserts and HIP process parameters determined as a result of preliminary mathematical modeling.

Adaptive criterion—a criterion, that is used for adaptation of mathematical model in order to obtain the said required parameters of the complex shape part.

Adapted mathematical model—the mathematical computer model of densification and shrinkage of irreversibly deformed capsules and inserts with powder, which is modified as a result of adaptation produced in accordance with the adaptive criterion.

One or more embodiments of the invention comprise an adaptive method for manufacturing of parts of the similar complex shape by using hot isostatic pressing of powder materials. This method comprises:

determination of the base mathematical model of densification and shrinkage describing densification of powder material in irreversibly deformed capsules, containing inserts that form the internal structure during hot isostatic pressing, i.e. under the influence of uniform pressure, temperature and time, accounting for the rheological properties of powder material as well as the material of capsules and inserts as a function of temperature, pressure and time;

formation of database of material rheological properties that is built by the special experiments including densification of powder material in the interrupted HIP cycles and obtaining porous samples and then testing these samples on hot upsetting at the temperature of the interruption of the HIP cycles with further interpolation of the values of the yield strength of powder material as a function of temperature;

selection of a part of the most complicated geometry among the similar complex shape parts which should be made from the given material by hot isostatic pressing;

determination of required parameters of the complex shape part, which include final density achieved as a result of HIP, geometrical parameters of external and internal surfaces and their tolerances;

calculation of the initial geometry of the capsule, inserts, and HIP process parameters by using mathematical modeling basing on the initial database of material properties of the powder, capsules and inserts and the geometry of a selected complex shape part, formation of virtual test part as a virtual object, that is created by preliminary modeling of densification and shrinkage of an irreversibly deformed capsule with powder and inserts during hot isostatic pressing and presents a computer model of the given complex shape part obtained after the said modeling;

manufacturing of a test complex shape part by using geometry of the irreversibly deformed can, inserts and HIP process parameters determined by the preliminary modeling;

formation of the discrepancies between the manufactured test part and the said virtual test part;

formation of adaptive criterion;

adaptation of the base computer model so that the said discrepancies between manufactured and virtual parts are minimized;

creation of geometry of the irreversibly deformed cans and inserts and determination of the HIP process parameters for every similar complex shape part by using the said adapted computer model;

manufacturing of every part of the given group of the similar complex shape parts by using hot isostatic pressing of powder materials by using geometry of the irreversibly deformed cans, inserts and parameters of the HIP process specified by using the created adapted computer model with database corresponding the manufactured part.

All basic procedures of disclosed adaptive method can be combined into three general groups so that the said adaptive method for manufacturing of parts of the similar complex shape by using hot isostatic pressing of powder materials and irreversibly deformable capsules and inserts utilized as adaptation tools, based on creation of a virtual part by mathematical computer modeling and manufacturing of a test part, comprises:

$1^{st}$ group of procedures. Selection of a part of the most complicated geometry among the similar complex shape parts to be made from a given powder material by hot isostatic pressing; specification of the initial geometry of the capsule, inserts, and HIP process parameters by using mathematical modeling basing on the initial database of material properties of the powder, capsules, inserts and the geometry of a selected complex shape part; creation of a virtual part; manufacturing of a test complex shape part by using geometry of the irreversibly deformed can, inserts and HIP process parameters determined by the said modeling.

$2^{nd}$ group of procedures. Analysis of the discrepancies between the manufactured test part and the said virtual test part and adaptation of the base computer model so that the discrepancies between the manufactured test part and the said virtual test part are minimized. Application of the adapted mathematical model of densification and shrinkage of irreversibly deformed capsules, inserts and powder during hot isostatic pressing to the calculation of the geometrical parameters of the capsule and inserts for the given complex shape part and the other parts of the similar complex shape made from a given powder material.

$3^{rd}$ group of procedures. Manufacturing of every part of the given group of the similar complex shape parts by using hot isostatic pressing of the powder material with geometry of the irreversibly deformed cans, inserts and parameters of the HIP process specified by using the created adapted computer model.

Another embodiment of the invention is a method of creation of virtual test part, comprising:

Step 1—Formation of a database of the material properties for the joint deformation of powder, can and insert materials during hot isostatic pressing for the adaptive control of densification and shape formation using capsule and inserts as an adaptation tool.

Step 2—Formation of the base configuration for the said capsules and inserts basing on the base mathematical model of densification and shrinkage, so that the values of shrinkage during HIP is minimized for the selectively net shape surfaces.

Step 3. Creation of the virtual complex shape part on the base of the mathematical modeling of step 2 by using the said model of the densification and deformation process.

Another embodiment of the invention is a method of manufacturing of the test part done through manufacturing of irreversibly deformed capsule, inserts, using powder and HIP process parameters obtained as a result of modeling using the base mathematical model.

One or more embodiments of the invention is a method of formation of the adaptive criterion as the minimum of discrepancies between manufactured test part and virtual test part.

Another embodiment of the invention is the method of adaptation of the base mathematical model of densification and shrinkage of capsule and inserts with powder during HIP performed by virtual iterations of the base model parameters, so that discrepancies between manufactured and virtual test parts are minimized.

One more embodiment of the invention is the method of manufacturing of similar complex shape parts from a given material using the said adapted model for hot isostatic pressing of the said powder, skipping the step of manufacturing a test part, for the new geometrical parameters of irreversibly deformed capsules and inserts, by the said process of creation of a virtual part and then direct manufacturing of a given complex shape part.

FIG. 1 illustrates basic steps of creation of adaptive method for manufacturing of parts of the similar complex shape by using hot isostatic pressing of powder materials:

block "Parts of the similar complex shape" includes information about a group of parts which should be manufactured from the same powder material using HIP and have similar complex shape including internal structure, and transfers this information to the blocks of "Preliminary calculations for the can and inserts" and "Modeling block";

block "Base mathematical model of densification and shrinkage" comprises standard mathematical model based on the equations for the irreversible compressible porous media, describing densification of powder material in irreversibly deformed capsules, containing inserts that form the internal structure during hot isostatic pressing and transfers this model into "Modeling block";

block "Database of material rheological properties" includes a database which is built by the special experiments including densification of powder material in the interrupted HIP cycles and obtaining porous samples and then testing these samples on hot upsetting at the temperature of the interruption of the HIP cycles with further interpolation of the values of the yield strength of powder material as a function of temperature; this block transfers its data to "Modeling block".

block "Required parameters of the complex shape part" comprises information about parameters, which include final density achieved as a result of HIP, geometrical parameters of external and internal surfaces and transfers this information to "Modeling block";

"Modeling block" comprises computer software producing preliminary and iterative repeated modeling of densification and shrinkage of a can of a given geometry containing a given powder and inserts under hot isostatic pressing and transfers produced information to block "Primary geometry for can and inserts and process parameters, creation of the virtual test part";

block "Primary geometry for can and inserts and process parameters, creation of the virtual test part" specifies primary geometry for can and inserts and process parameters, creates the virtual test part and transfers this information to blocks "Manufacturing of a capsule and inserts" and "Manufacturing of a test part";

block "Manufacturing of a capsule and inserts" comprises manufacturing of the capsule and inserts that is necessary for work of "Manufacturing of a test part";

block "Manufacturing of a test part" creates manufactured test part by using the geometry of the irreversibly deformed can and inserts and HIP process parameters determined as a result of preliminary mathematical modeling;

block "Determination of discrepancies between manufactured test part and virtual test part" determines the discrepancies between manufactured test part and virtual test part and transfers this information to the block "Adaptation of mathematical model by virtual iterations so that discrepancies between manufactured and virtual and parts are minimized";

block "Adaptive criterion" forms adaptive test controlling discrepancies between manufactured test part and virtual test part and transfers this test to block "Adaptation of mathematical model by virtual iterations so that discrepancies between manufactured and virtual and parts are minimized";

block "Adaptation of mathematical model by virtual iterations so that discrepancies between manufactured and virtual and parts are minimized" creates the adapted mathematical computer model of densification and shrinkage of irreversibly deformed capsules and inserts with powder, which is modified as a result of adaptation produced in accordance with the adaptive criterion, and transfer this model to block "Adapted mathematical model for of densification and shrinkage for the complex shape parts";

block "Adapted mathematical model for of densification and shrinkage for the complex shape parts" is used for determining the geometry of the capsules and inserts and manufacturing by hot isostatic pressing of the given complex shape part and other similar complex shape parts of the given group.

We claim:

1. An adaptive method for manufacturing of parts of the similar complex shape by using hot isostatic pressing (HIP) of powder materials and irreversibly deformable capsules and inserts utilized as adaptation tools, based on creation of a virtual part by mathematical computer modeling and manufacturing of a test part, comprising:

Step 1: Selection of a part of the most complicated geometry among the similar complex shape parts to be made from a given powder material by hot isostatic pressing; specification of the initial geometry of the capsule, inserts, and HIP process parameters by using mathematical modeling basing on the initial database of material properties of the powder, capsules, inserts and the geometry of a selected complex shape part; creation of a virtual part; manufacturing of a test complex shape part by using geometry of the irreversibly deformed can, inserts and HIP process parameters determined by the said modeling;

Step 2: Analysis of the discrepancies between the manufactured test part and the said virtual test part and adaptation of the base computer model so that the discrepancies between the manufactured test part and the said virtual test part are minimized, and Application of the adapted mathematical model of densification and shrinkage of irreversibly deformed capsules, inserts and powder during hot isostatic pressing to the calculation of the geometrical parameters of the capsule and inserts for the given complex shape part and the other parts of the similar complex shape made from a given powder material;

Step 3: Manufacturing of every part of the given group of the similar complex shape parts by using hot isostatic pressing of the powder material with geometry of the irreversibly deformed cans, inserts and parameters of the HIP process specified by using the created adapted computer model.

2. A method in accordance with claim 1 wherein the said virtual part is built in the following steps:

Step 1: Formation of a database of the material properties for the joint deformation of powder, can and insert materials during hot isostatic pressing for the adaptive control of densification and shape formation using capsule and inserts as an adaptation tool;

Step 2: Formation of the base configuration for the said capsules and inserts basing on the base mathematical model of densification and shrinkage, so that the values of shrinkage during HIP are minimized for the selectively net shape surfaces;

Step 3: Creation of the virtual complex shape part on the base of the mathematical modeling of step 2 by using the said model of the densification and deformation process.

3. A method in accordance with claim 1 wherein manufacturing of the test part is done through manufacturing of irreversibly deformed capsule, inserts, using powder and HIP process parameters obtained as a result of said modeling.

4. A method in accordance with claim 1, wherein the adaptive criterion is built as the minimum of discrepancies between manufactured test part and virtual test part.

5. A method in accordance with claim 1 wherein adaptation of mathematical model of densification and shrinkage of capsule and inserts with powder during HIP is done by virtual iterations of the base model parameters, so that discrepancies between manufactured and virtual test parts are minimized.

6. A method in accordance with claim 1 wherein other similar complex shape parts from a given material are manufactured using the said adapted model for hot isostatic pressing of the said powder, skipping the step of manufacturing a test part, for the new geometrical parameters of irreversibly deformed capsules and inserts by the said process of creation of a virtual part and then direct manufacturing of a given similar complex shape part.

* * * * *